United States Patent [19]

Tande et al.

[11] 4,196,888

[45] Apr. 8, 1980

[54] WINCHES

[75] Inventors: Arne Tande; Kjell Reiten; Svein Martinussen, all of Brattvåg, Norway

[73] Assignee: A/S Hydraulik Brattvaag, Brattvåg, Norway

[21] Appl. No.: 869,133

[22] Filed: Jan. 13, 1978

[51] Int. Cl.[2] ..... B66D 1/48

[52] U.S. Cl. ..... 254/172; 91/390

[58] Field of Search ..... 254/172, 173 R, 150 FH, 254/186 R; 60/388, 420, 421, 445, 446; 91/390, 358 R, 364

[56] References Cited

U.S. PATENT DOCUMENTS

| | | | |
|---|---|---|---|
| 3,080,719 | 3/1963 | Strand | 254/173 R |
| 3,595,133 | 7/1971 | Foster | 91/390 |
| 3,684,244 | 8/1972 | Houck | 254/173 R |
| 3,965,798 | 6/1976 | Estlick | 91/390 |
| 4,064,910 | 12/1977 | Weisenberger | 91/390 |

*Primary Examiner*—Kenneth W. Noland
*Attorney, Agent, or Firm*—J. Harold Nissen

[57] ABSTRACT

Winch especially a ship's winch designed for mooring, hauling, towing and the like. A control system adapted to establish a desired tension in the hawser via the drum of the winch by regulating the power of the drive motor so as to pacify or mitigate peak tensional loads on the hawser. A regulatable transmission arranged between a control member of a control device incorporated in the control system and a movable component selected from the winch drum and its drive shaft to control the control member in a linearly regulatable actuation movement depending upon the movement of the movable component. The transmission is regulatable to an actuation position in which a desired tension is established in the hawser from the winch drum on exposure of a desired length of the hawser.

10 Claims, 3 Drawing Figures

Figure 1:
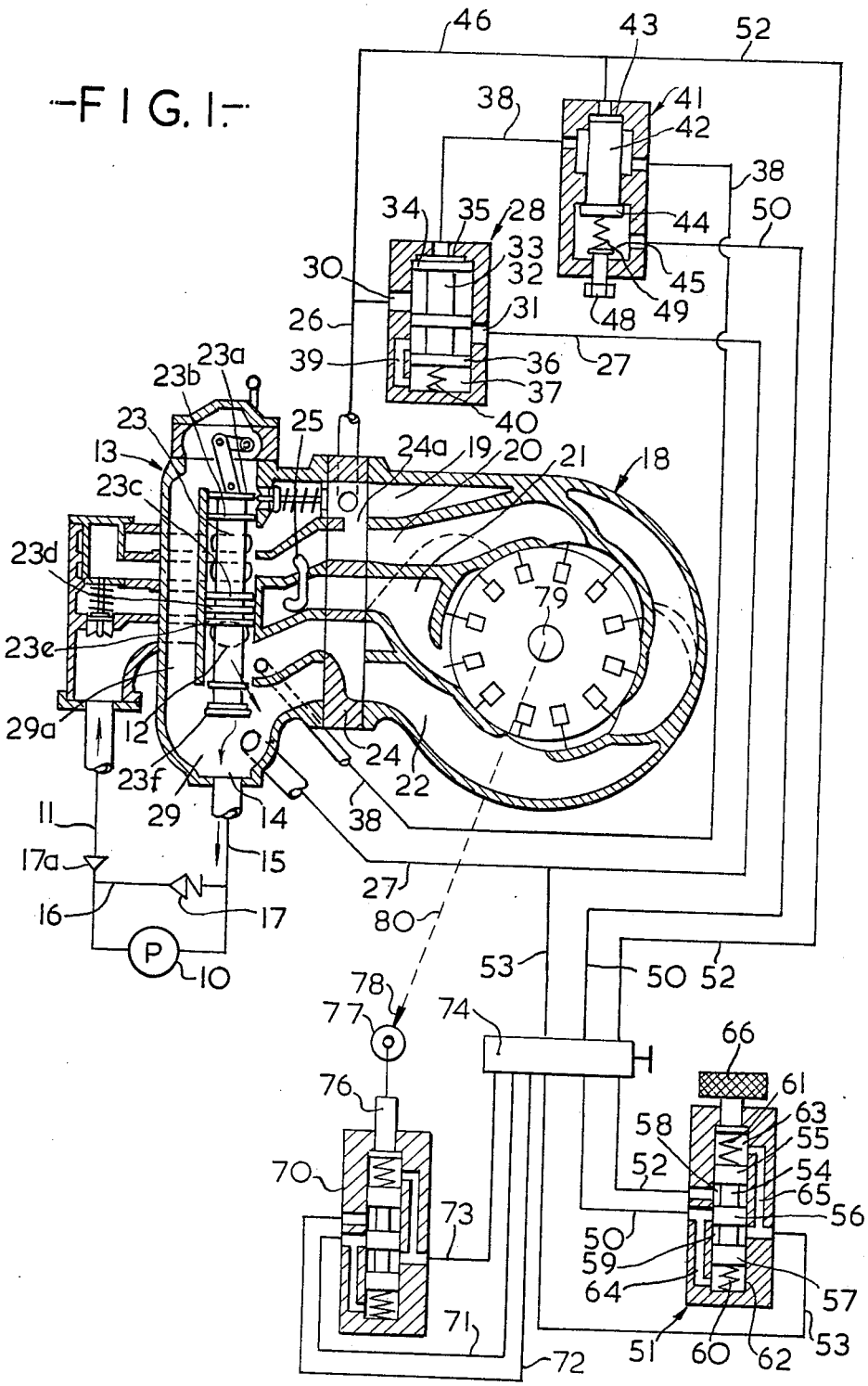

—FIG. 2—
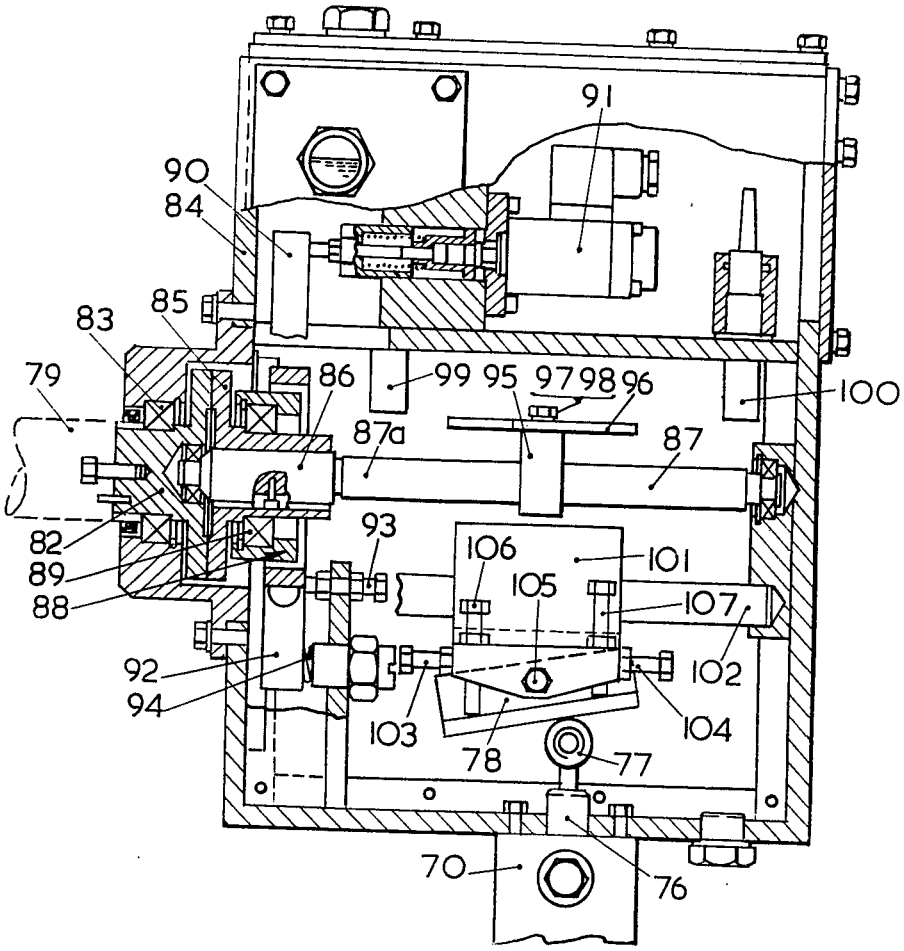

-FIG. 3-
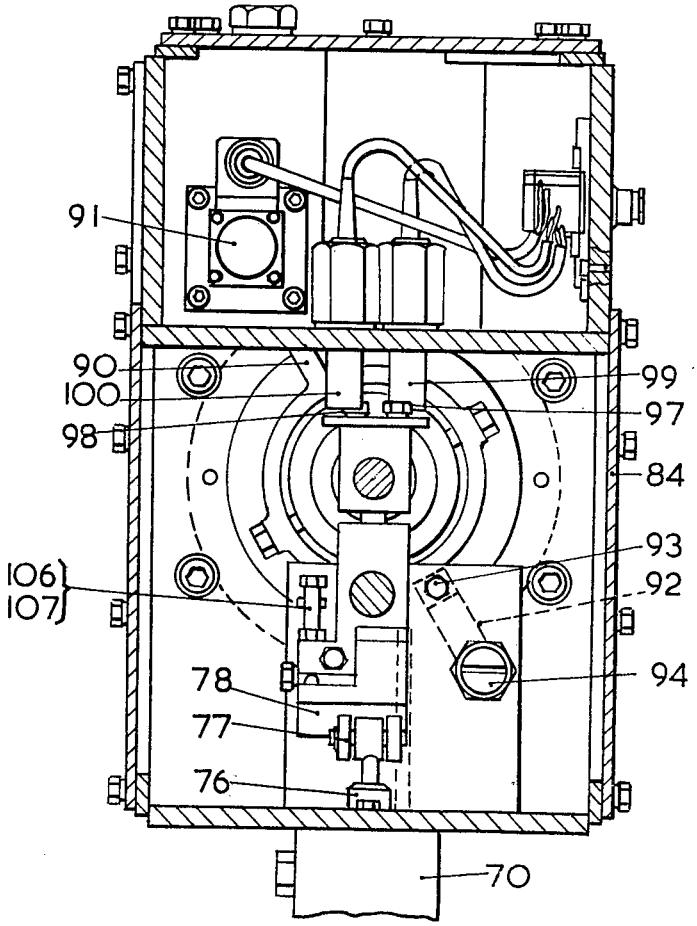

WINCHES

This invention relates to winches, especially ships' winches designed for mooring, hauling, towing and similar purposes, in which the winch comprises a control system, including a control means and adapted to establish a desired tension in the hawser via the winch's drum by regulating the power of the motor in order to mitigate and/or level out possible peak loads in the tension which is exerted externally on the hawser.

In various operations of board ship or another vessel, and especially in towing operations, there are many practical problems which have to be solved. Hitherto, the elasticity in fiber hawsers has been utilised to a large extent to take up the variations in the load which occur in the hawsers by virtue of waves, wind, current or the like. In towing operations in increasing waves, wind and current, the length of the hawser has to be increased. By reason of the large lengths and thereby the large weight of the hawser in question, the hawser (the cable) will hang in a large arc between the towing vessel and the towed vessel and actually in many waters will be towed with the sweep of the hawser along the sea bottom. In practice, it is necessary to have large lengths of towing hawser so that the vessel can react individually to the different forces which occur, without wearing the hawser.

Such long hawsers make difficult, to a large degree, the control of the drawn vessel and involve great danger, for example, in poor visibility. Hawsers of such a length render difficult mooring during loading and unloading in connection with bore platforms, loading buoys or the like.

In Norwegian Patent Application No. 753,898 a hydraulic system for winches is disclosed, in which, inter alia, an effective tension control in the hawser of the winch can be obtained based upon a controlled pressure limitation. With this the effect of sudden tension loads in the hawser can be limited and the effect of shock-type pressure increases in the working cycle of the hydraulic system can be restricted. Generally, this is ensured by means of a valve adjustment of the hydraulic system at a predetermined maximum pressure and on exceeding this maximum pressure, the associated winch drum releases the hawser until the desired pressure in the hawser is reestablished. Immediately the tension in the hawser falls below the desired tension the valve will, however, take care that the slack in the hawser is hauled in until the predetermined maximum pressure in the hydraulic system is reestablished.

An object of the present invention is to be able to mitigate and/or level out possible peak loads in the tension which is exerted from the outside on the hawser, in a sufficiently reliable and effective manner. A particular aim is to achieve a combined tension control of the hawser and control of the exposed length of hawser so that there is an attempt, all the time, to maintain the hawser in position with a desired length of the hawser exposed and with a desired tension in the hawser but with the possibility for subduing and/or levelling out the afore-mentioned peak loads in the hawser.

According to the present invention a winch especially a ship's winch designed for mooring, hauling, towing and the like comprises a control system adapted to establish a desired tension in the hawser via the winch drum by regulating the power of the drive motor so as to pacify peak tensional loads on the hawser; regulatable transmission means arranged between a control member of a control means incorporated in the control system and a movable component selected from the winch drum and its drive shaft to control said control member in a linearly regulatable actuation movement depending upon the movement of said movable component; said transmission means being regulatable to an actuation position in which a desired tension is established in the hawser from the winch drum on exposure of a desired length of said hawser, the occurrence of an increase in tension in the hawser which produces a corresponding movement of the movable component in a direction corresponding to the direction of slackening of the winch causing the transmission means via the control means to increase gradually and in a regulatable manner the power of the drive motor while on the occurrence of a drop in tension in the hawser which produces a corresponding movement of the movable component in a direction corresponding to the direction of pull of the winch causing the transmission means via the control means to reduce gradually and in a regulatable manner the power of the drive motor.

Thus a controlled, qualified slackening of the hawser can be permitted, as a consequence of occurring external forces which increase the tensional force in the hawser, increasing tensional force from the winch on the hawser being provided the more the hawser is slackened. As a result there is the possibility of maintaining the tensional force in the hawser within an acceptably controlled level without the danger of breakage of the hawser, at the same time as the slackening of the hawser can be limited in a controlled manner. Consequently, the subsequent drawing in of the hawser is also possible in a more rapid and better controlled manner. Similarly, the drawing in of the hawser can be permitted as a result of the occurrence of a drop in tension in the hawser with decreasing tensional forces in the order to counteract undesired jerks in the hawser.

It will be possible to employ various types of transmissions between the control member of the control valve and the drum of the winch, for example based on tachometers, potentiometers or hydraulic valves with associated regulating means or based on gear transmissions or the like. In all cases, a signal or an actuating force which is emitted from the drum of the winch is able to release a control force which can directly actuate the control member of the control valve.

In a preferred embodiment, the transmission comprises a cam member which is moved synchronously with the movable member of the winch in a direction across the direction of movement of the control member and cooperates with a cam follower fixed to the control member.

According to the invention it is possible to adjust the cam surface of the cam member into various inclined positions relative to the direction of movement of the cam member by means of regulation means. It is especially favorable to employ remotely controllable regulation means, so that the regulation means can, for example, be remotely controlled from the bridge of the ship or vessel in order to be able to make easier thereby the adjustment of the tensional loading in the hawser as required and according to the prevailing conditions with respect to the size of the waves, wind strength, current strength etc. or so that the actuation of various cooperating winches can be adapted more readily as required, immediately the conditionspermit this.

By regulating the inclined position of the cam surface of the cam member by remote control, the degree of actuation of the control member of the control valve can be regulated during operation so that, for example, with a steeper inclined position of the cam surface there can be obtained a steeper build-up of the pressure in the motor of the winch or a steeper pressure drop in the motor of the winch than with a more slackened inclined position of the cam surface.

In a preferred construction, the control valve is included in a hydraulic system which comprises an operating valve known per se for adjusting the drive motor of the winch to exert a predetermined tension in the hawser and an outlet valve known per se for delivery of a larger or smaller quantity of pressure medium from the operating valve outside the drive motor of the winch and, if necessary, also a pressure-limiting valve known per se for controlling the outlet valve, the control valve being connected to the outlet valve and/or the pressure-limiting valve.

In this way, a hydraulic system corresponding to that which is shown in Norwegian Patent Application No. 753,898 can be employed, with the advantages which this involves, and in addition, the particular effect which is intended according to the invention is obtained.

In order that the invention can be more clearly understood, a convenient embodiment thereof will now be described, by way of example, with reference to the accompanying drawings in which:

FIG. 1 is a schematic representation, partly in section, of a hydraulic system for a winch, FIG. 2 is a view, partly in vertical section, of a control means for the winch, and FIG. 3 is another view, partly in vertical section, of the control means of FIG. 2 but at right angles thereto.

In the following description, reference will be made to a practical embodiment of the inventin which is adapted to the hydraulic system which is illustrated in FIGS. 4–6 of Norwegian Patent Application No. 753,898. In the known system, as will be referred to later in the following description, there are worked in as additional equipment, components which are employed according to the invention. By way of introduction, it will be stressed that said additional equipment can also be adapted to other hydraulic systems in which effective tension control for the hawser can be ensured.

Referring to the drawings, there is illustrated a hydraulic system of limited capacity. From a non-reversible pump 10, there passes a main supply conduit 11 to an inlet port 12 of an operating valve 13. From an outlet 14 of the operating valve 13, there extends a main return conduit 15 back to the suction side of the pump 10. Between the supply conduit 11 and the return conduit 15 runs a circulation conduit 16 which is closed by a safety valve 17. At 17*a* there is shown a back pressure valve.

Triplex motor 18 has three bores 19, 20, 21 which form supply passages to the motor on operating the motor in the lifting direction and has a bore 22 which forms a discharge passage from the motor on operating in the lifting direction. On operation in the slackening direction, the bore 22 forms a supply passage to the motor, while the bores 19, 20, 21 form discharge passages from the motor. The operation of the motor in the one or the other direction, together with the regulation of the speed of drive, adjustment of the motor in the stop position etc. is controlled by means of a slide 23 of the operating valve 13 in a manner known per se. The operating valve corresponds substantially to the construction as shown in Norwegian Patent specification No. 86,819, in which there are described further details of the operating valve and its mode of operation.

One of several practical constructions possible is shown in the drawings in which there is inserted an intermediate piece 24 between operating valve and motor. In the intermediate piece there is designed an open connection 24*a* between the bores 19 and 20. At 25 there is shown a short circuit connection between the bores 20 and 21. Consequently, there is a direct pressure medium connection between the bores 19, 20, 21. This represents a preferred construction and it is apparent that this is not a necessary measure in order that the system according to the invention will function. Between the bore 19 and the discharge 29 of the operating valve, there is designed a discharge duct 26, 27 with associated discharge valve 28. One end of the duct 26 is connected to the bore 19 via the intermediate piece 24, while one end of the duct 27 is connected to the return side of the system. The opposite ends of the ducts 26, 27 are each connected to a respective port 30 and 31 on the valve 28. The ports 30, 31 are mutually separated in the position shown in FIG. 1 by means of a flange 32 on a slide 33. The one end of the slide with associated flange 34 is received in a control pressure chamber 35, while the opposite end of the slide with associated flange 36 is received in a counterforce chamber 37. By means of a control conduit 38, the control pressure chamber 35 is connected to the bore 22, while the counterforce chamber 37 is connected to the discharge duct 27 via a branch passage 39. Between the slide 33 and the bottom of the counterforce chamber there is inserted a compression spring 40.

The control conduit 38 extends directly through a control valve 41. The control valve 41 is equipped, at the one end of a control slide 42, with a pressure control chamber 43 and, at the opposite end of the control slide having associated flange 44, is equipped with a "counterforce chamber" 45. The pressure control chamber 43 communicates, via a branch conduit 46, with supply passage 26 of the discharge duct and has the same pressure conditions as the motor ducts 19–21. In the counterforce chamber 45, there is arranged a compression spring 49 between the flange 44 and an adjustment screw 48 in the bottom of the chamber. The force which acts on the slide 42 in the counterforce chamber consists of the force from the spring 49. The force from the spring 49 can be regulated by the adjustment screw 48.

The counterforce chamber 45 is connected to a working conduit 50 from a pressure reduction valve 51. The valve 51 gets its feed pressure via a feed pressure conduit 52 from branch conduit 46 of the control valve 41, that is to say a pressure corresponding to the pressure in the bores 19–21. The valve 51 has a discharge conduit 53 in connection with the discharge 29 via the discharge duct 27. A slide 54 having three flanges 55, 56, 57 with intermediate chambers 58, 59 is shown. The flange 56 covers, in the illustrated position, the port opening to the working conduit 50, while the accompanying chambers 58 and 59 communicate with the feed pressure conduit 52 and the discharge conduit 53 respectively, this position of the slide 54 being ensured by means of two opposite compression springs 60, 61 and the pressure which prevails in the associated chambers 62, 63. The one compression spring 60 is received in the chamber 62 which, via a branch conduit 64, is connected to the working conduit 50, while the other compression spring 61 is received in the chamber 63 which, via a branch conduit 65, is connected to the discharge conduit 54. The compression spring 60 has a constant pressure force, while the pressure force of the compression spring 61 can be regulated by means of a wheel 66. By increasing the force of the spring 61, the slide 54 can be moved in a direction downwards in the drawings, and the pressure can be correspondingly increased in the working conduit until the pressure in the chamber 62 together with the force from the spring 60 balances the force from the spring 61. By correspondingly reducing the force from the spring 61, the slide 54 can be moved upwardly and reduces thereby the pressure in the working conduit 50 to a similar degree, one obtaining discharge from the working conduit 50 via the chamber 59 to the discharge conduit 53 until the force against opposite ends of the slide is evened out.

In the position shown in FIG. 1, the operating valve stands in the stop position, the slide 23 thereof being set so that the inlet port 12 from the main supply conduit 11 communicates with outlet 14 of the operating valve, while the bores 19–21 are closed off via the flanges 23*a*, 23*b* or 23*c*, 23*d* and 23*e* from said outlet and ensure thereby the position of the motor in the stop position. The pressure medium circulates from the pump in a cycle through the operating valve outside the motor.

When the slide is led towards the slack position, the oil proceeds to the discharge valve 28. The bore 22 stands in open connection with the inlet port 12 and is supplied, without restriction, pressure medium from the supply conduit 11. The motor is driven with this in the slack direction, that is to say in a direction with an external force (for example the weight of the load on a loading winch), which acts on the motor. As a result, the motor is driven as a pump by the external force. In instances where the external force is small, the motor is driven, in addition, by the force which is exerted by the pressure medium in the bore 22. By means of the force of the pressure medium in the bore 22, the slackening speed can thereby be increased. In instances where the external force is large, the external force is determining and the problem consists essentially in reducing the slackening speed. The slackening speed is determined by how much oil is introduced into the bore 22. The pressure in the bore 22 can be regulated by permitting passage of pressure medium past the lower flange 23*f* of the slide 23 to the discharge 29. This passage past the flange 23*f* can be choked or closed by means of the flange 23*f*. In the slack position of the slide, the pressure will be adjusted to that pressure which is necessary in order to drive the motor in the slack direction, and in order to open the discharge valve 28. The pressure can be largest when there is no load which acts with the slackening movement. The operating valve must be moved further out from the initial position at high than at low slackening pressures, by reason of throttling past the flange 23*f*.

When there shall be slackening, the initial position of the slide 23 will be the stop position (FIG. 1). The bore 22 will then be free of pressure and the discharge valve 28 closed. When the slide 23 is moved in an upward position, flange 23*f* of the slide 23 contracts the passage between the bore 22 and the discharge 29. There will then be built up a pressure in the bore 22 and the pressure in the control conduit 38 will rise at the same time. When the pressure in the control conduit 38 exceeds the force (spring force) which acts on the slide 33 from the counterforce chamber 38 (via the spring 40), the discharge valve 28 is opened and provides discharge from the bore 19 via the discharge ducts 26, 27 to the exhaust 29. If the external force (the load on the loading winch) tries to draw the motor more rapidly in the slack direction than the available quantity of pressure medium must admit on throttling past the flange 23*f*, the pressure in the bore 22 will drop and there is produced a corresponding drop in pressure in the control conduit 38 so that the discharge valve 28 is completely or partially closed until the pressure in the bore 22 builds up again.

By means of the branch conduit 46 from the discharge duct 26, the control valve 41 can be controlled and thereby the control valve 41 employed in combination with the discharge valve 28 as a tension-limiting/-pressure-limiting arrangement. Thus, with a pressure increase in the bores 19–21 above the force which prevails in the counterforce chamber 45, for example, with varying tensions in the wire of the winch (in mooring winches, towing winches, trawl winches and the like) or on an abrupt transition from lifting position to stop position (cargo winches), the connection between the branch conduit 46 and the control conduit 38 via the control chamber 43 opens and produces a pressure increase in the control conduit so that the discharge valve opens and diverts surplus pressure medium from the discharge duct 26 via the discharge valve 28 to the discharge duct 27 and further to the exhaust 29. Consequently, by regulating the force against the slide 42 via the adjustment screw 48 of the compression spring 49, the pressure in the bores 19–21 can be adjusted to a maximum pressure. Immediately this maximum pressure is exceeded, there is obtained a pressure discharge via the discharge valve 28 until the pressure in the bores 19–21 is limited to the desired pressure, that is to say the force which is established by the adjustment screw 48. In this way, one has the possibility of adjusting the winch to a desired limited tension (tension limitation) and relieving undesired pressure increases, for example on braking during operation in the slack direction, and remaining undesired pressure increases in the bores 19–21. As a result, one can, for example, with a mooring winch, trawl winch, towing winch or the like let out or take in wire all according to whether the external force increases or diminishes.

During use, on movement of slide 42 of the control valve 41 so that the valve 41 opens the connection between the conduits 46 and 38, there will occur a pressure increase in the working conduit 50 so that slide 54 of the valve 51 is moved in a direction upwardly in the drawing and one gets a corresponding pressure relief, via the chamber 59, to the discharge conduit. Immediately the slide 42 is brought back to the closed position, there occurs a pressure drop in the working conduit 50 so that slide 54 of the valve 51 is moved in a direction downwardly in the drawing and one gets a corresponding pressure increase via the chamber 58 from the feed conduit 52 until a power balance is obtained at opposite ends of the slide 54.

A particular advantage of the remote control system according to the invention is that it is based essentially on pressure distribution in the conduits 50, 52, 53 without any substantial flow of pressure medium. Consequently, by the use of relatively viscous pressure oil in the hydraulic system and long pipes, there can be obtained an accurate evening out of the pressure in the conduits 50, 52, 53 and with a rapid and perfect control.

The above described mode of operation corresponds to that which is achieved by the solution according to Norwegian Patent Application No. 753,898.

A valve 70 which is included in the additional equipment to the known hydraulic system as described above is connected via branch conduits 71, 72 73 and a coupling means 74 to the conduits 50, 52, 53. By means of the coupling means 74 one can connect in, as required, either the valve 51 (so that the mode of operation is obtained as described in Norwegian Patent Application No. 753,898) or the valve 70 (so that there is obtained the mode of operation intended according to the invention).

The valve 70 is constructed similarly to valve 51, with the only difference that the manual regulating screw 66 is replaced by a control member 76. The control member 76 is equipped with cam follower element 77 in the form of a wheel which is actuated by a cam element 78 which is driven synchronously with drive shaft 79 of the winch via a transmission 80. Further details of the additional equipment are shown in FIGS. 2 and 3.

By way of introduction, it will be stressed that when the cam follower element 77 is actuated by the cam element 78 during operation of the winch, there is obtained an automatic actuation of the valve 70 on the occurrence of a deviation in the exposed length of hawser desired. This length-regulating effect occurs parallel to the tension-regulating effect which is otherwise obtained by the above described hydraulic system. This is achieved in the illustrated embodiment by means of a valve 70 having the same general construction and function as the valve 51, the only difference being that the manually controlled regulating screw 66 of valve 51 is replaced by the automatically controlled control member 76.

In FIG. 2, the drive shaft of the winch is indicated by broken lines 79. To the drive shaft 79 there is fastened a first coupling element 82 which is rotatably mounted, via a roller bearing 83, in a housing 84. A second coupling element 85 is movable axially towards and away from the coupling element 82 on a slide portion 86 just by the one end of a helical guide member 87. The guide member is rotatably mounted with the one end in the coupling element 82 and with the opposite end in the opposite side of the housing 84. The coupling element 85 is in fixed rotational engagement with the guide member 87 but can be moved axially along slide portion 86 of the guide member by means of a holder 88 universally jointed relative to the coupling element 85 and rotatably mounted on the coupling element 85 via a ball bearing 89. A first arm 90 of the holder 88 is actuated by a remote controlled coupling and uncoupling mechanism 91 and a second arm 92 directed diametrically oppositely is actuated by a regulation screw 93 and a compression spring 94 which exerts a moment towards the holder 88 about the regulating screw 93. This moment, in addition to the force from the coupling mechanism 91, provides for abutment between the coupling elements 82, 85, therebeing supporting abutment for the holder via the arm 90 in the coupling mechanism 91.

A nut 95 engages screw portion **87*a* of the guide member 87. One end of the nut is connected to a disc 96 having two stops 97, 98 which engage their respective feelers 99, 100 which are adapted to emit a visual and an acoustic warning signal when the nut 95 is displaced to predetermined warning positions at opposite ends of the guide member 87**.

The nut 95 is connected at the opposite end to a holder 101 for the cam element 78, the holder 101 being slidably mounted on a slide guide 102. The holder 101 is provided with two end stoppers 103, 104 which form supporting abutments against opposite sides of the housing 84 in two outer positions of the holder in which the holder is blocked and produces slipping in the connection between the coupling elements 82, 85. The end stoppers 103, 104 are regulatable adjustable in the holder. The cam element 78 is rotatably mounted in the holder about a pivot 105 and is adjustable into various inclined positions relative to the holder by means of regulating screws 106, 107. Alternatively, the can element can be connected to the holder via remotely controllable regulating means (not shown) such as electromotors, hydraulic cylinders and the like. If desired, the cam element can be pivotably mounted in the one regulating means and connected to a slide groove of a second regulating means. As a result, the cam surface of the cam element can be tilted by moving only the second regulating means relative to the aforementioned one regulating means and by moving both the regulating means, the cam surface of the cam element can be displaced relative to the holder 101.

By regulating the tilting of the cam surface to the path of movement of the cam element along the slide guide 102 and by regulating the distance of the cam surface from the holder 101, the degree of action on the cam follower element 77 can be regulated as desired so that the valve 70 can be actuated to different degrees on movement of the hawser of the winch drum within a definite regulating zone.

The mode of operation of the valve 70 is as follows:

It is assumed that normal tension control is established, via the valve 51, after the desired length of hawser is let out or released via the winch. Thereafter the valve 51 is disconnected and the valve 70 is engaged instead. It is seen that the tension control valve 41 is set so that the winch does not let out. This is done in order to avoid shocks to the installation in the event of a current break, the system in such circumstances returning to manual control.

By way of the end stoppers 103, 104 and the path controls, the limits as to how far in or out the length displacement of the hawser can be permitted away from the desired exposed length are adjusted thereafter. The limits are set so that they are normally not exceeded but if they should be, a sound and/or light alarm is emitted in a manner not shown, for example, to the ship's bridge. In an emergency situation, the emergency release mechanism is actuated directly from the bridge so that the coupling elements for automatic tension regulation and length regulation are disconnected.

In FIG. 2, there is shown the valve 70 in the closed position, the hawser being held at the desired tension with the desired length exposed.

On the occurrence of increasing tensions in the hawser—beyond the desired tension which is established by the hydraulic system of the winch—the tension-regulating effect will come into force and hawser will be let out by rotation of the drum of the winch in the one direction. This turning of the drum of the winch entails the guide member 87 displacing the cam element 78 towards the right in FIG. 2 and the slide **70*a* of the valve 70 is thereby displaced so that there is exerted a gradually increasing tensional force in the winch and with this also a gradually increasing tensional action from the winch to the hawser. The further the cam element is moved towards the right in FIG. 2, the greater the valve 70 is actuated and the greater is the tensional action exerted from the winch to the hawser. As a consequence of the gradually increasing tensional force from the winch while the latter steadily releases hawser the increase in tension in the hawser will be gradually subdued and when the tension increase which is caused by external factors diminishes again, the hawser is returned to the desired tension and to the desired exposed length, the valve 70** reverting to its initial position when the cam element assumes its starting position.

If the tensional loading in the hawser should fall below the desired tension, the tension-regulating effect will again come into play but with the opposite effect, hawser being drawn in with rotation of the drum of the winch in a direction opposite to that mentioned above. Correspondingly, this causes the cam element 78 to be moved towards the left in FIG. 2 and thereby the slide 70*a* of the valve 70 is displaced so that there is exerted a gradually diminishing tensional force in the winch and with this also a gradually diminishing tensional action from the winch to the hawser. With subsequently increasing tensional loads in the hawser from external sources, the hawser will revert to the initial position at the desired tension and with the desired exposed length, the valve 70 being returned correspondingly to the starting position.

In the illustrated embodiment, there are employed three cooperating valves 28, 41 and 51 for normal tension-regulating functions and three cooperating valves 28, 41 and 70 for combined tension-regulating and length-regulating functions. Alternatively, there can be employed a single valve instead of the three mentioned valves, such a single valve being dimensioned to form a combined exhaust valve and control valve and being able to carry out the functions of the valves 28 and 70 in combination.

In the illustrated embodiment, there is shown a transmission between the control member of the valve 70 and the movable part of the winch consisting of a linearly movable cam member which actuates a cam follower member on the control member of the valve 70. However, it is possible to employ also other mechanical, hydraulic or electrical components instead of those shown so that one has mechanical, hydraulic or electrical transmissions or a combination of these. For example, there can be utilised instead of the mechanical control of the cam member with a guide member with associated nut, a tachometer with hydraulic or electrical transmission to the cam member or there can be employed a hydraulic slide control with associated regulating valve or a potentiometer with amplifier and regulating valve.

It is apparent that the remote control can also be performed by means of various mechanical, hydraulic and electrical components as required.

In the illustrated embodiment, there is shown a hydraulic system of limited capacity based on that pressure medium which is supplied from a single pump. Alternatively, there can be employed two cooperating pumps of which the one can be permanently connected to the hydraulic system while the other can normally supply its pump medium in circulation but, immediately there is a need for it, can feed the pump medium to the hydraulic system. In this way, there is the possibility of being able to obtain an increase or a reduction of the revolutions per minute of the winch immediately there is a need for it. The connection and disconnection of the pump medium from the other pump to the hydraulic system can occur by control from the control valve 70, there being emitted a signal from the control valve 70 for the actual change over as a function of the actuation of the control valve. For example, extra pump medium can be supplied to the hydraulic system immediately there is a need for a rapid pulling in of the hawser on the winch. Consequently, at the same time as the tension in the hawser is reduced, there is the possibility of being able to obtain a rapid increase of the speed of pulling in controlled in a regulated way by the control valve 70.

There is described above as a preferred embodiment a hydraulic winch but the invention comprises also other types of winches, such as steam and electric winches in which instead of the illustrated hydraulic control valve, there is utilised another control device for the associated steam medium-driven or electrical control system.

What we claim:

1. Winch especially a ship's winch designed for mooring, hauling, towing and the like, which comprises:

(a) a winch drum, a drive shaft, therefor, a hawser supported on said drum and a drive motor operatively connected to said drive shaft for reversible rotation of the latter on respectively drawing in and letting out said hawser;

(b) a control system adapted to establish a desired tension in the hawser via the winch drum by regulating the power of the drive motor so as to pacify peak tensional loads on the hawser; and (c) regulatable transmission means arranged between a control member of a control means incorporated in the control system and a movable component selected from the winch drum and its drive shaft to control said control member in a linearly regulatable actuation movement depending upon the movement of the movable component;

said transmission means comprising a cam element movable synchronously with said movable component in a direction across the direction of movement of the control member and cooperating with a cam follower element fixed to said control member, and said transmission means being regulatable to an actuation position in which a desired tension is established in the hawser from the winch drum on exposure of a desired length of said hawser, the occurrence of an increase in tension in the hawser which produces a corresponding movement of the movable component in a direction corresponding to the direction of slackening of the winch causing the transmission means via the control means to increase gradually and in a regulatable manner of the power of the drive motor while on the occurrence of a drop in tension in the hawser which produces a corresponding movement of the movable component in a direction corresponding to the direction of pull of the winch causing the transmission means via the control means to reduce gradually and in a regulatable manner the power of the drive motor.

2. Winch as claimed in claim 1, wherein the control member is associated with stop means which limit its region of movement and the transmission means comprises a slip coupling for controlled handling of the winch via the control means also outside the region of movement of the control member.

3. Winch as claimed in claim 1, wherein the cam element has a cam surface which is adjustable into various inclined positions relative to the direction of movement of the cam element by means of regulating means.

4. Winch as claimed in claim 3, wherein the regulating means are remotely controllable.

5. Winch as claimed in claim 4, wherein the winch is hydraulically driven and the control means is a control valve of a hydraulic system which comprises an operating valve for adjustment of the drive motor to exert a predetermined tension in the hawser and a discharge valve for exhausting a quantity of pressure medium from the operating valve outside the drive motor.

6. Winch as claimed in claim 5, wherein the hydraulic system also comprises a pressure-limiting valve for controlling the discharge valve, the control valve being connected to at least one of the discharge and pressure-limiting valves.

7. Winch as claimed in claim 6, wherein the control member is associated with stop means which limit its region of movement and the transmission means comprises a slip coupling for controlled handling of the winch via the control means also outside the region of movement of the control member.

8. Winch as claimed in claim 1, wherein the winch is hydraulically driven and the control means is a control valve of a hydraulic system which comprises an operating valve for adjustment of the drive motor to exert a predetermined tension in the hawser and a discharge valve for exhausting a quantity of pressure medium from the operating valve outside the drive motor.

9. Winch as claimed in claim 8, wherein the hydraulic system also comprises a pressure-limiting valve for controlling the discharge valve, the control valve being connected to at least one of the discharge and pressure-limiting valves.

10. Winch as claimed in claim 1, wherein the transmission means is either mechanical, hydraulic or electrical.

* * * * *